United States Patent [19]

Haynie et al.

[11] 3,992,763

[45] Nov. 23, 1976

[54] METHOD OF MAKING POWDERED METAL PARTS

[75] Inventors: Robert Nelson Haynie, Northville; Ramjee Pathak, Plymouth, both of Mich.

[73] Assignee: Federal-Mogul Corporation, Detroit, Mich.

[22] Filed: Sept. 13, 1974

[21] Appl. No.: 505,702

[52] U.S. Cl. ..... 29/420.5; 148/15.5; 148/16.5; 148/12 R; 29/DIG. 18

[51] Int. Cl.[2] ..... B22F 3/24

[58] Field of Search ..... 148/15.5, 16.5, 12 R; 29/420.5, DIG 18

[56] References Cited

UNITED STATES PATENTS

| | | | |
|---|---|---|---|
| 2,489,838 | 11/1949 | Webb | 148/16.5 X |
| 2,489,839 | 11/1949 | Whitney | 148/16.5 |
| 2,757,446 | 8/1956 | Boegehold et al. | 29/420.5 |
| 2,827,407 | 3/1958 | Carlson et al. | 148/16.5 |
| 3,150,444 | 9/1964 | Reen | 29/420.5 |
| 3,889,350 | 6/1975 | Mocarski | 29/420.5 |

*Primary Examiner*—C.W. Lanham
*Assistant Examiner*—V. Rising

[57] ABSTRACT

Gas carburizing of a briquetted powder metal preform prior to hot forging of the preform to acquire a fully dense, carburized powdered metal part.

6 Claims, 4 Drawing Figures

FIG. 3.
A–A
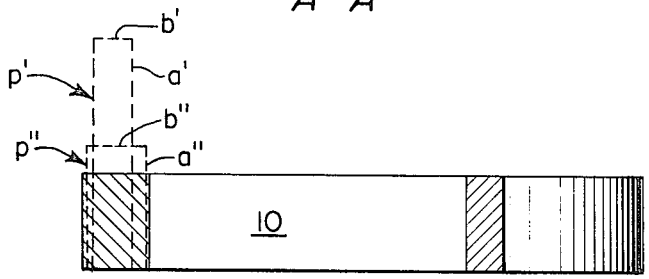
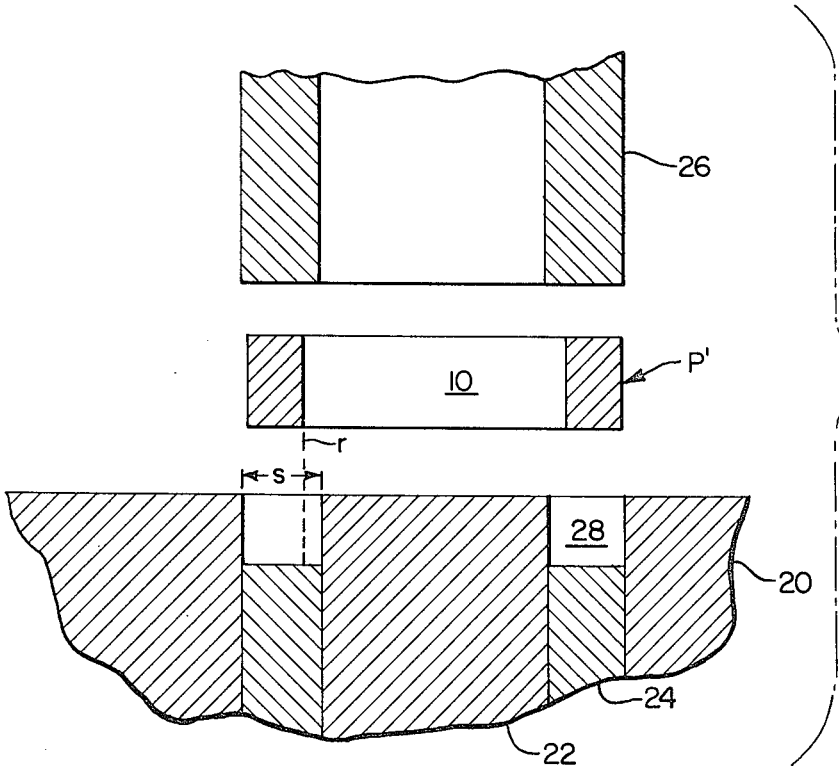
FIG. 4.

METHOD OF MAKING POWDERED METAL PARTS

BACKGROUND OF THE INVENTION

This invention relates generally to an improved method of obtaining fully dense, carburized, powdered metal, low alloy steel parts, the most common of which are the powdered metal equivalents of AISI 4000 and 4600 wrought steel series and particularly those having sintered carbon levels in the range of 0.22% to 0.37% by weight. More specifically, this invention is related to the improved method of carburizing powdered metal briquetted preform during the sintering step, or alternatively successively thereafter, and precedent to the foregoing step. Prior to our invention such powdered metal low alloy steel parts were first brought from a sintered preform to full density by a forging operation such as shown in U.S. Pat. No. 3,772,935, owned by assignee of the present invention; and subsequently, carburized by methods conventional for wrought steels. Such conventional heat treat methods include both liquid and gas carburizing. Where gas carburizing is used, either a batch type or continuous furnace may be used. The parameters to be controlled to achieve carburization of a fully dense part of specific hardness, case depth and carbon gradient are generally well known, as described, for example, in *Metals Handbook*, Eighth Edition, Vol. 2, pp. 67–114, published by the American Society for Metals.

SUMMARY OF THE INVENTION

Our invention is to carburize the briquette, either during sintering, or successively thereafter in a two zone operation, and before the further consolidation of the preform to fully dense condition and final shape, i.e. by forging. The advantage of so doing over the conventional carburizing techniques for any one particular part are substantial and include:

a. the carburizing is obtained more quickly because the preform is at the most at only 70 to 90% of its full density, and therefore the carbon being liberated by the carbon rich carburizing gas penetrates the preform more rapidly than in conventional wrought carburizing techniques;

b. carburizing is further hastened by reason of the fact the preform case depth can be substantially less than the required case depth of the final forged part provided one orientates the preform in the forging die so that by compression and flow the case depth at the critical wall of the part is increased.

Additional advantages accruing over the prior art, all of which perhaps should be regarded as ancillary to the above are substantial reduction in capital investment for equipment, greater utilization of plant space, longer carburizing equipment life, and less carburizing gas, heat and other utilities as well as less manpower, to achieve the same results as presently obtained with conventional methods.

A BRIEF DESCRIPTION OF THE DRAWINGS

FIG. 3 shows a cross-sectional side view of the transmission stator clutch cam taken along section line A—A of FIG. 2.

FIG. 4 shows an expanded side view of the sintered carburized preform in the forging die prior to forging.

DETAILED DESCRIPTION OF THE INVENTION

Figure 1:
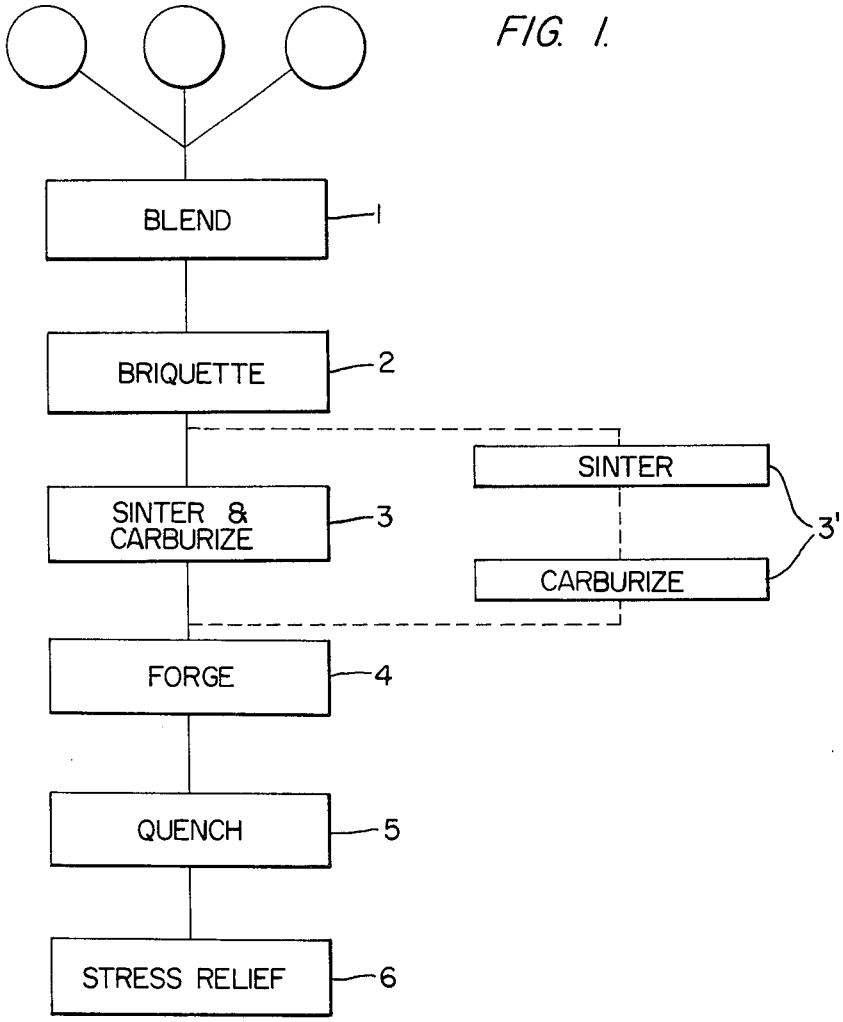
FIG. 1 shows a schematic layout of the overall process of the subject invention beginning with the step of blending and concluding with post-forging steps of quenching and stress relief.

Referring to FIG. 1, the inventive process includes the steps of blending 1, pressing or briquetting 2, sintering and carburizing 3, 3′, forging 4, quenching 5 and stress relieving 6.

The blending step comprises blending either the alloyed metal powder, or a combination of metal powders which together make up the desired steel alloy powder, with graphite and die lubricant, for example acrawax. The purpose of the graphite addition is to raise the carbon content of the preform, as is well known. And the purpose of acrawax is to act as a die lubricant for the preform, as is well known. Any other equivalent additives could be added for those mentioned.

The pressing or briquetting step 2 comprises pressing the blended powder into a low-density, semi-final shape. In the example illustrated in FIG. 4 this semi-final shape resembles a ring.

The sintering and carburizing step comprises in our preferred embodiment the simultaneous sintering and carburizing of the preform as shown in step 3, which can be referred to as a single furnace single zone operation. As an alternative, as shown in dotted lines, the sintering and carburizing of the preform can be accomplished in separate successive steps, shown in 3′. This process may be referred to as a single furnace two-zone operation. With either embodiment it is contemplated one should use a single conventional sintering furnace of the horizontal, continuous feed type equipped with the utilities and controls necessary to provide a carburizing gas atmosphere.

With the single furnace, single zone process 3, standard sintering conditions, namely temperature and time, are maintained within the furnace and there is provided a carburizing gas atmosphere throughout, either within or without forced circulation of the gas, i.e. by internal fan.

With the single furnace, two zone, process 3′, the first zone is primarily for purposes of sintering and the second zone for carburizing. As is well known, conventional sintering furnaces, as are contemplated for use herewith comprise a plurality of zones including, in order, a preheat zone for burning out lubricants and anywhere from one to three separate hot zones for sintering depending on the choice of the operation. For purposes of describing our invention, the first zone referred to is the hot zone, regardless if a sintering zone, whether it comprises a multiple of zones. In such case the temperature in the first zone will be in the range of 2000° to 2080° F and the parts held a period of time sufficient to achieve the desired degree of sinter; while in the second zone the carburizing temperature will range from 1500° to 1800° F, again depending on the part specification, gas and other parameters.

It is also within the scope of our invention to accomplish the sintering and carburizing step 3′ in two separate furnaces, one for sintering and the other for subsequent carburizing.

Not one of the aforementioned embodiment is considered particularly desirable over the other since in each case one must consider the particular part specifications to arrive at the most efficient operation. However, where close control of case depth or carbon and hardness gradient is required, it will generally be more advantageous to use the two zone sinter and carburizing process step 3'. Specific examples are given hereafter.

After sintering and carburizing, the preform is forged, as shown at 4, to its final shape and then quenched 5. Forging is done at preform temperature ranging generally from 1600°–1750° F. The temperature of the forged part is then allowed to substantially stabilize before the part is quenched as shown at 5, preferably in a quenchant such as oil. The generally preferred forge/quench process is described more fully in co-pending patent applicaion U.S. Ser. No. 400,071 assigned to the assignee of the subject invention. A final step of stress relieving, shown as numeral 6, may also be desirable for particular application. The result is a fully dense, full carburized powdered metal part of Rc60 minimum hardness on the exterior, a hardness gradient as required, and a tough inner core for strength characteristics. The known primary application for the invention is in the production of automotive transmission parts such as the low-reverse position overrunning clutch cam and the stator clutch cam. Additionally, gears and antifriction bearing components commonly must meet these same requirements.

Figure 2:
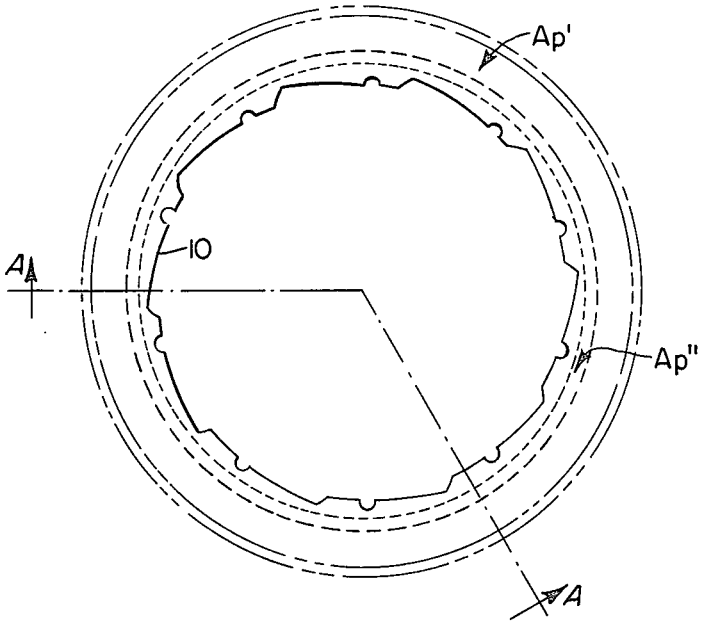
FIG. 2 shows a cross-sectional side view of a transmission stator clutch cam manufactured in accordance with the subject invention and after forging.

A typical stator clutch cam is shown in FIG. 2, wherein the race 10 into which the clutch rollers ride constitutes the critical wall surface subject to wear and accordingly requires high hardness.

According to a second feature of the invention, the preform is designed with an upset ratio substantially greater than one to one so that metal flow as distinguished from metal powder densification of the preform in the forging die takes place. This technique together with proper selection of geometry of the preform in the die cavity is used to cause the metal to flow in the area of the critical wall thickness which in turn effects an increase in the desired case depth. This happening, although discovered by accident, is used to advantage by carburizing the preform during the sintering operation to a lesser depth than required in the final forged product and making up the difference during forging. The result is improved efficiency during the sinter-carburizing step with no loss of efficiency elsewhere in the process. It has also been determined that the metal flow itself enhances the overall strength of the forged part. To illustrate what is meant by "upset ratio" there is shown in full lines in FIG. 3 the section A—A of the forged stator clutch cam of FIG. 2. Superimposed thereon and shown schematically in dashed lines is a preform $p'$ of width $b'$ and thickness $a'$ in accordance with the invention and having an upset ratio substantially greater than one to one; while shown in dotted lines is a preform $p''$ of width $b''$ and thickness $a''$ which represents a conventional upset ratio slightly greater than one to one. Each preform $p'$ and $p''$ has a plan surface area designated as Ap' and Ap'', respectively, as shown in FIG. 2. The upset ratio for the example given is:

$$\frac{A_f - A_o}{A_o} \times 100$$

WHEREIN:

$A_f$ is the plan area of the forged part;

$A_o$ is the plan area of the part before forging; and

WHEREIN:

$A_o = A_{p'}$

In practice, an upset ratio of generally 40% has been found to be desirable. An acceptable upset ratio range would be 10% to 80%. Of course, in the example of FIGS. 2 and 3 referred to, the preform height $a'$ must be increased to such extent that the volume of preform p' is the same as that of the conventional preform $p''$ to insure full densification. The conventional upset ratio is usually referred to as a tolerance of $$1 \frac{+0.1}{-0.0} / 1$$

in order to assure full densification of 99.6 – 100% of wrought density.

A suitable conventional forging die is shown in FIG. 4 wherein there is shown a die 20 having core 22, a lower punch 24 and upper punch 26. The lower punch 22 and die 20 define the die cavity 28 into which is placed the preform $p'$. The die cavity is notably of greater width than the preform as referred to above. Upon lowering of upper punch 26 with a force in the order of 60–90 tons per square inch, full consolidation is achieved.

Despite the fact FIG. 4 is not intended to be to scale, it is intended to be shown that width $s$ of the die cavity is greater than width $b'$ of preform $p'$, and that as depicted by dotted reference line $r$ preform $p'$ is sized or orientated with respect to die cavity 28 such that substantially all lateral metal flow occurs between critical wall 10 and the adjoining die surface of core 22.

Having described the invention generally, specific examples are given hereinbelow in Table I.

TABLE I

| PHYSICAL DESCRIPTION | PART 1 | | | PART 2 |
|---|---|---|---|---|
| O.D. (inches) | 4.52 | | 4.52 | 3.64 |
| I.D. (inches) | 3.52 | | 3.52 | 2.75 |
| HEIGHT (inches) | 1.22 | | 1.22 | .590 |
| SPECIALS (Tooth Hrd.) | I.D. AND O.D. CASE HARDENED E.B. WELD AREA LOW CARBON | | | |
| PLAN SURFACE AREA (in.²) | 6.52 | | 6.52 | 4.24 |
| SINTER (at No./hr.) | 400 | | 400 | 400 |
| POWDER METAL COMPOSITION | 4620 | | 4620 | 46F27 |
| SINTERING AND CARBURIZING CONDITIONS: | | | | |
| ENDOTHERMIC GAS (ft³/hr) | 2400 | 2400 | 2400 | 2400 |
| TEMPERATURE (° F) | 2050±15 | 2050±15 | 1600 to 1700 | 2050±15 |
| TIME (minutes) | 30 | 30 | 10 to 20 | 30 |
| DEW POINT (° F) | −8 to −18 | −5 to −18 | +0 to +10 | −10 to −18 |
| NO. OF FURNACES | ONE | TWO | | ONE |

TABLE I-continued

| NO. OF ZONES | ONE | TWO | ONE |
|---|---|---|---|
| FORGE: | | | |
| PRESSURE (Tons/in.$^2$) | 70 to 90 | 70 to 90 | 70 to 90 |
| TEMP. AT FORGE (° F) | 1600–1750 | 1600–1750 | 1600–1750 |
| QUENCH | +4 to 8 sec. dwell before quench | +4 to 8 sec. dwell before quench | +4 to 8 sec. dwell before quench |
| BATH COMPOSITION | Park AAA Oil | Park AAA Oil | Park AAA Oil |
| BATH TEMPERATURE (° F) | 140–180 | 140–180 | 140–180 |
| FINAL CHARACTERISTICS | Core Hrd. | Core Hrd. | Core Hrd. |
| HARDNESS: | 31 to 48 $R_c$ Surface 62 $R_c$ Max. | 31 to 48 $R_c$ Surface 62 $R_c$ | 31 to 48 $R_c$ Surface 62 $R_c$ |
| CASE DEPTH (inches) | 0.060 min. 0.080 max. | .090 min. 0.120 max. | |

Part No. 1 was a low-reverse position overrunning clutch cam and of the same general shape as Part No. 2, the stator clutch cam shown in FIG. 2.

As will be noted from Table 1, Part 1 was subjected to both a single furnace, single zone sintering and carburizing step and a two furnace two zone sinter-carburize step. While the single zone step is advantageous for acquiring conventional case depth, the two zone sinter-carburize step yields a deeper case depth without prolonging the time or elevating the temperature required to achieve desired degree of sinter, and more importantly allows for better control of case depth and carbon gradient because the carburizing is finished at lower temperature.

Using conventional batch carburizing techniques, namely carburizing after forging, this same part would have required 6–12 hours carburizing time at a furnace temperature of 1650°–1750° F, plus an additional 2 hours diffusion at lower temperature.

During forging of Part No. 2, the required case depth for wear surface 10 was 0.60 inches. The preform *a'*, *b'* was carburized to a case depth of 0.40 inches minimum and the increase to 0.60 inches minimum was achieved by forging using an upset ratio of 40%.

While the invention has been described in connection with a preferred embodiment and specific examples thereof, it is not intended to limit the invention to any particular form set forth, but, on the contrary, it is intended to cover such alternatives, modifications and equivalents as may be included within the spirit and scope of the invention as defined by the appended claims.

We claim:

1. A process for obtaining a substantially fully dense, carburized, low alloy ferrous, powdered metal part comprising the sequential steps of:

a. briquetting a low alloy ferrous metal powder preform having a fixed uniform initial carbon content throughout both the case and inner core thereof, the briquetted preform having at least one surface thereof which in the final forged form is required to be of a certain case depth, b. sintering said preform at a temperature from 2000°–2100° F, c. carburizing said preform to substantially increase the initial carbon content thereof in said case by providing a controlled carbon atmosphere of rich endothermic gas and maintaining said preform in said controlled atmosphere for a predetermined period of time sufficient to obtain a desired case depth of final carbon content substantially greater than said initial carbon content of the case as well as the final carbon content of said inner core, d. forging said preform at a temperature range from about 1600° to about 1750° F to a density of 99.6% to 100% that of wrought density to obtain a forged part, e. cooling said forged part by quenching to thereby obtain a desired case depth.

2. A process as defined in claim 1 wherein the said forged part is cooled by quenching in an oil bath substantially immediately after forging but not until the temperature thereof has been allowed to substantially stabilize.

3. A process as defined in claim 1 wherein the upset ratio of said preform at said one surface is in the range of 10% to 80% including selecting the geometry of said preform relative to the forging die cavity and orientating the preform within said die cavity so that during forging the metal flows in the area of critical wear surface to thereby increase the case depth of the preform.

4. A process as defined in claim 1 wherein, the fixed uniform initial carbon content of said preform is less than 0.22% by weight and wherein the final carbon content is in the range of 0.22% to 0.37% by weight and to a desired case depth ranging from 0.60 inches to 0.120 inches.

5. A process as defined in claim 4 wherein, said forged part is quenched in an oil bath immediately after forging and substantial temperature stabilization of the forged part.

6. A process for obtaining a substantially fully dense, carburized, low alloy ferrous, powdered metal part comprising the steps of:

a. forming a briquetted preform, the briquetted preform having at least one surface thereof which in the final forged form is required to be of a certain case depth and wherein the upset ratio of said preform at said critical wear surface is greater than 10% and in the order of 40%.

b. sintering said preform at a temperature from 2000°–2100° F c. simultaneously, during sintering, carburizing said preform by providing a controlled carbon atmosphere of endothermic gas and maintaining said preform in said controlled atmosphere for a predetermined period of time in the range of 20 to 40 minutes to obtain a desired case depth d. thereafter maintaining said preform in substantially the same atmosphere at a reduced temperature of from 1500°–1750° F for a further period of time in the range of 7 to 25 minutes to acquire a deeper, more controlled case depth e. forging said preform at a temperature ranging from 1600°–1750° F, including selecting the geometry of the said preform relative to the forging die cavity and orientating the preform within said die cavity so that the metal flows in the area of said one surface to thereby increase the case depth of the preform f. cooling said preform by quenching in an oil bath substantially immediately after forging but not until the temperature thereof has been allowed to substantially stabilize.

* * * * *

UNITED STATES PATENT AND TRADEMARK OFFICE

CERTIFICATE OF CORRECTION

PATENT NO. : 3,992,763

DATED : November 23, 1976

INVENTOR(S) : Robert Nelson Haynie and Ramjee Pathak

It is certified that error appears in the above-identified patent and that said Letters Patent are hereby corrected as shown below:

Column 5, line 38, "0.60 inches" should read --0.060 inches--.

Column 5, line 39, "0.40 inches" should read --0.040 inches--.

Column 5, line 40, "0.60 inches" should read --0.060 inches--.

Column 6, line 44, (the last line of claim 4), "0.60 inches" should read --0.060 inches--.

Signed and Sealed this

Twenty-second Day of March 1977

[SEAL]

*Attest:*

RUTH C. MASON
*Attesting Officer*

C. MARSHALL DANN
*Commissioner of Patents and Trademarks*